US005445458A

United States Patent [19]

Uchiyama

[11] Patent Number: 5,445,458

[45] Date of Patent: Aug. 29, 1995

[54] AUTOMATIC PLATEN GAP ADJUSTING APPARATUS

[75] Inventor: Yukihiro Uchiyama, Nagano, Japan

[73] Assignee: Seiko Epson Corporation, Tokyo, Japan

[21] Appl. No.: 208,375

[22] Filed: Mar. 10, 1994

[30] Foreign Application Priority Data

Mar. 12, 1993 [JP] Japan ..... 5-078986

[51] Int. Cl.[6] ..... B41J 11/20

[52] U.S. Cl. ..... 400/55; 400/56; 400/57

[58] Field of Search ..... 400/55, 56, 57, 58, 400/59

[56] References Cited

U.S. PATENT DOCUMENTS

| | | | |
|---|---|---|---|
| 4,676,675 | 6/1987 | Suzuki et al. | 400/56 |
| 4,861,175 | 8/1989 | Hori et al. | 400/61 |
| 4,881,835 | 11/1989 | Niikawa | 400/56 |
| 4,990,004 | 2/1991 | Kawahara et al. | 400/56 |
| 5,156,464 | 10/1992 | Sakai | 400/56 |

FOREIGN PATENT DOCUMENTS

| | | | |
|---|---|---|---|
| 169665 | 7/1991 | Japan | 400/56 |
| 191492 | 2/1993 | Japan | 400/56 |

*Primary Examiner*—Edgar S. Burr
*Assistant Examiner*—John S. Hilten
*Attorney, Agent, or Firm*—Sughrue, Mion, Zinn, Macpeak & Seas

[57] ABSTRACT

An automatic platen gap adjusting apparatus is provided with (i) a stepping motor for moving a carriage provided with a recording head in the direction of a platen, (ii) a rotary encoder for producing a plurality of pulse signals proportional to the rotational speed of the motor, the rotary encoder being equipped with a detection mark on its circumference, (iii) a time difference integrating device for obtaining the integrated value of the time difference between the pulse signal from the rotary encoder and the driving pulse of the stepping motor, while moving the carrier from a reference position in the direction of the platen, and (iv) an abutment decision device for detecting whether the value thus obtained has reached a predetermined value. The thickness of the paper is calculated by a paper thickness calculation device according to the number of pulses produced up to the moment the signal is produced from the abutment decision device. The apparatus of the present invention can automatically adjust the relative gap between the platen and the recording head with precision while preventing press marks from appearing on the paper.

12 Claims, 6 Drawing Sheets

AUTOMATIC PLATEN GAP ADJUSTING APPARATUS

BACKGROUND OF THE INVENTION

The present invention relates to an apparatus for automatically adjusting the gap between a platen and a printing head in proportion to the corresponding thickness of recording paper.

With recording heads, particularly wire dot recording heads for use in printing characters by striking wires against recording paper via ink ribbons, the striking strokes of the wire have to be set as small as possible in order to effect high-speed printing.

On the other hand, since the wire dot recording head must be strong in mechanical strength, to render it possible to make copies with the aid of a copying material, such printers are very versatile in the kinds of recording paper which they are capable of utilizing. Consequently, unlike other types of printers, for this kind of printer, the distance between the recording head and recording paper tends to vary to a greater extent.

For this reason, printers using wire dot recording heads are usually provided with a mechanism for adjusting the relative gap between the platen and the recording head. However, the problem is that selecting the optimum gap for a specific type of recording paper requires a great deal of skill and is also troublesome.

In order to solve the problem above, Examined Japanese Patent Publication No. Hei. 4-14634, for instance, discloses a printer providing an encoder for producing pulse signals corresponding to the movement of a carriage from the initial position and a control unit for processing feedback pulse signals from the encoder. In this case, when a recording head abuts against recording paper, the fact that a pulse motor for driving the carriage starts stepping out is detected from variations in the number of pulses from the encoder. The thickness of the recording paper is obtained from the movement of the carriage up to the point in time of abutment, so that the carriage position is made controllable according to the data thus obtained.

Notwithstanding, there still arises a problem in that, since the recording head is forced to abut against the recording paper until the pulse motor starts to step out, recording paper such as copying paper which colors in response to external force may bear press marks.

SUMMARY OF THE INVENTION

In view of the foregoing problems, an object of the present invention is to provide an automatic platen gap adjusting apparatus capable of accurately measuring the corresponding thickness of recording paper by forcing a carriage to contact the recording paper with only minimum required force.

In order to solve the foregoing problems, an automatic platen gap adjusting apparatus according to the present invention provides a stepping motor for moving a carriage provided with a recording head in the direction of a platen shaft, a movement detection device for outputting pulse signals proportional in number to the movement of the carriage, an abutment decision device for integrating, by moving the carriage from a reference position in the direction of a platen, the time difference between each stepping-motor driving pulse and the pulse signal produced from the movement detection device due to driving by the driving pulse so that it is detected whether the integrated time difference value has reached a predetermined value, a paper thickness calculation device for calculating the corresponding thickness of recording paper on the basis of the movement of the carriage from the reference position, and a control device for adjusting the relative gap between the carriage and the platen by driving the stepping motor according to the data given by the paper thickness calculation device.

With the automatic platen gap adjusting apparatus, while the movement of the carriage from the reference position in the direction of the platen is calculated, the time difference between the stepping-motor driving pulse and the pulse signal of the movement detection device is detected. When the integrated time difference value reaches the preset value, it is decided that the recording head has abutted against the recording paper before the stepping motor steps out. The corresponding thickness of the recording paper is calculated from the movement of the carriage until then. The relative gap between the platen and the carriage is thus set at the optimum value.

DESCRIPTION OF THE PREFERRED EMBODIMENTS

Referring to the accompanying drawings, a detailed description will subsequently be provided of an embodiment of the present invention.

Figure 2:
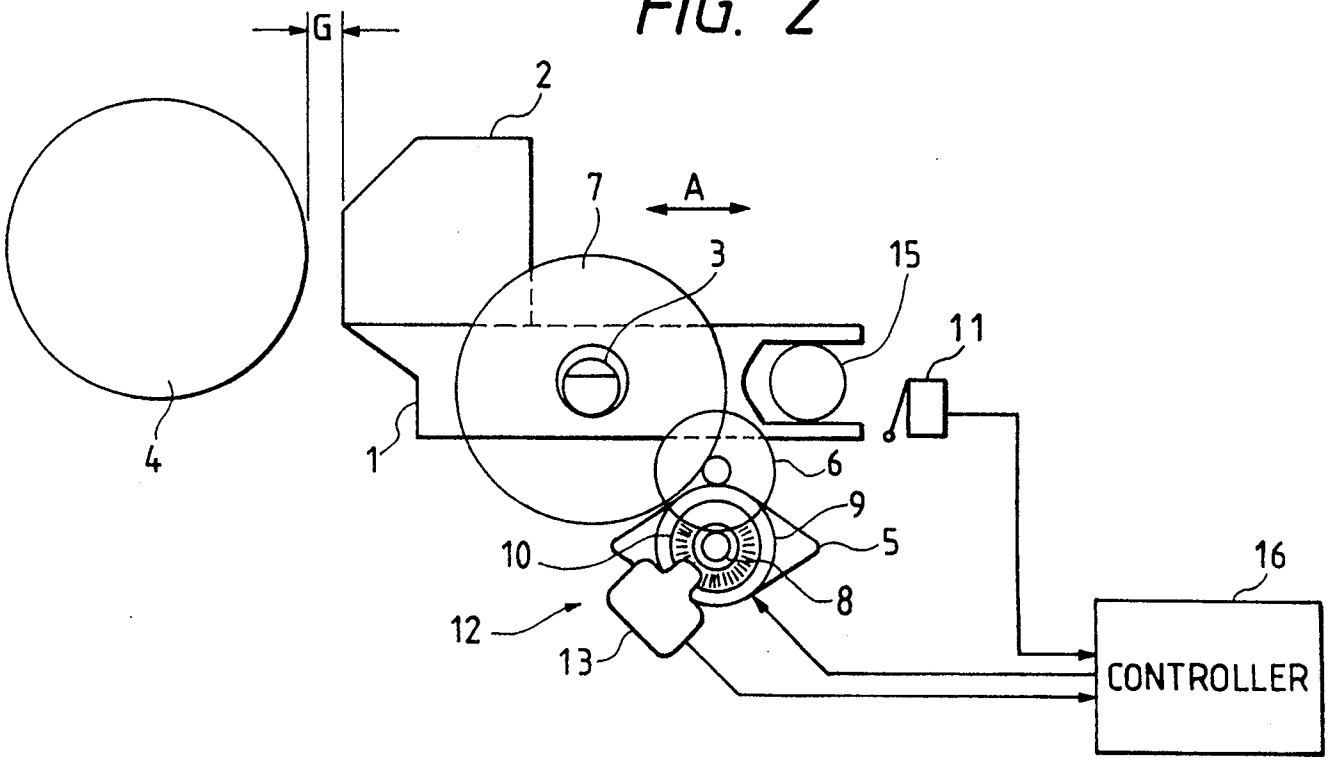
FIG. 2 is a diagram illustrating the construction of the periphery of a gap adjusting mechanism in a serial printer according to the present invention.

FIG. 2 illustrates a mechanism embodying the present invention and showing what is used for adjusting the relative gap between a platen and a recording head in a serial printer. In FIG. 2, numeral 1 denotes a carriage which is loaded with a recording head 2, provided on a guide shaft 3 rotatably fitted to the base in an eccentric condition and constructed so that it can adjust the relative gap G between the platen 4 and the recording head 2.

Further, numeral 5 denotes a stepping motor which is driven in 2—2 phase-excited state with a period of 3.5 milliseconds and coupled via a reduction gear 6 to a driven wheel 7 on the guide shaft 3. Moreover, a rotary encoder 12 is employed as a movement detection device. A code plate 10 of the rotary encoder 12 is fitted to a shaft 9 for the purpose of outputting pulse signals proportional in number to an angle of rotation. The code pattern of the code plate 10 is preferably selected so that one pulse is output in synchronization with the single-phase driving of the stepping motor 5. Further, numeral 11 denotes a position detector for detecting a reference position, for example, a micro-switch, which is set where the carriage 1 is situated farthest away from the platen 4. Further, numeral 13 denotes a code detection device forming part of the rotary encoder 12. Numeral 15 denotes a guide member for supporting the other end of the carriage 1.

Signals from the position detector 11 and rotary encoder 12 are applied to a controller 16 and used to obtain the optimum gap for the corresponding thickness of the recording paper being used. The controller 16 drives the stepping motor 5 to move the carriage 1 in the direction of arrow A in FIG. 2, thus adjusting the gap G between the recording head 2 and the platen 4.

Figure 1:
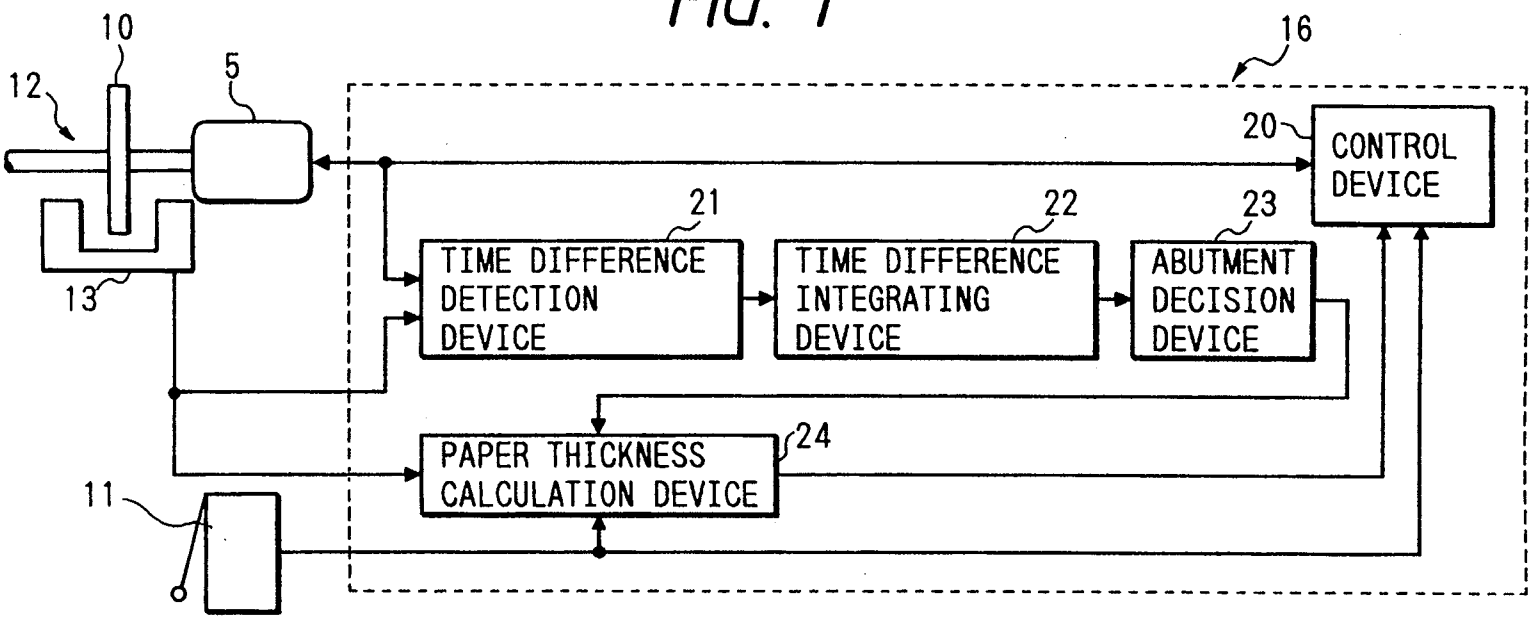
FIG. 1 is a block diagram illustrating an embodiment of the present invention.

FIG. 1 illustrates an example of the controller 16. In FIG. 1, numeral 20 denotes a control device for controlling the rotation of the stepping motor. When a loading switch (not shown) is depressed, the control device 20 causes the carriage 1 to travel to the reference position by moving away from the platen 4 until a signal issues from the position detector 11. Subsequently, the carriage 1 is moved in the direction of the platen so that the recording head 2 abuts against the recording paper. After the thickness of the recording paper is detected, the stepping motor 5 is driven so that an optimum gap is obtained for the recording paper that has been loaded.

Further, numeral 21 denotes a time difference detection device for detecting whether a change has arisen in the time difference between the pulse signal period from the rotary encoder 12 and the driving period of the stepping motor 5. An output $\Delta Tn$ is produced as a result. Further, numeral 22 denotes a time difference integrating device for calculating an integrated value $\Sigma(\Delta Tn)$ of the outputs $\Delta Tn$ and supplying the result to an abutment decision device 23 which will be described below.

As noted above, numeral 23 denotes an abutment decision device, which is adapted to output a signal when the integrated time difference value given by the time difference integrating device 22 coincides with a preset value. The preset value in this embodiment, is not greater than $\frac{1}{2}$ of the period of the stepping-motor driving pulse, for example, 1.5 milliseconds. In the case where the integrated time difference value is in the range of not greater than $\frac{1}{2}$ of the stepping-motor driving period, the stepping motor 5 increases an output torque in accordance with an increase of the integrated time difference value. Therefore, the stepping motor 5 does not step out.

Further, numeral 24 denotes a paper thickness calculation device for calculating the pulse signal from the rotary encoder 12 in accordance with the signal from the position detector 11 and for stopping the calculating operation in accordance with the signal from the abutment decision device 23. This permits the thickness of the recording paper to be calculated on the basis of the number of pulse signals.

Figure 3:
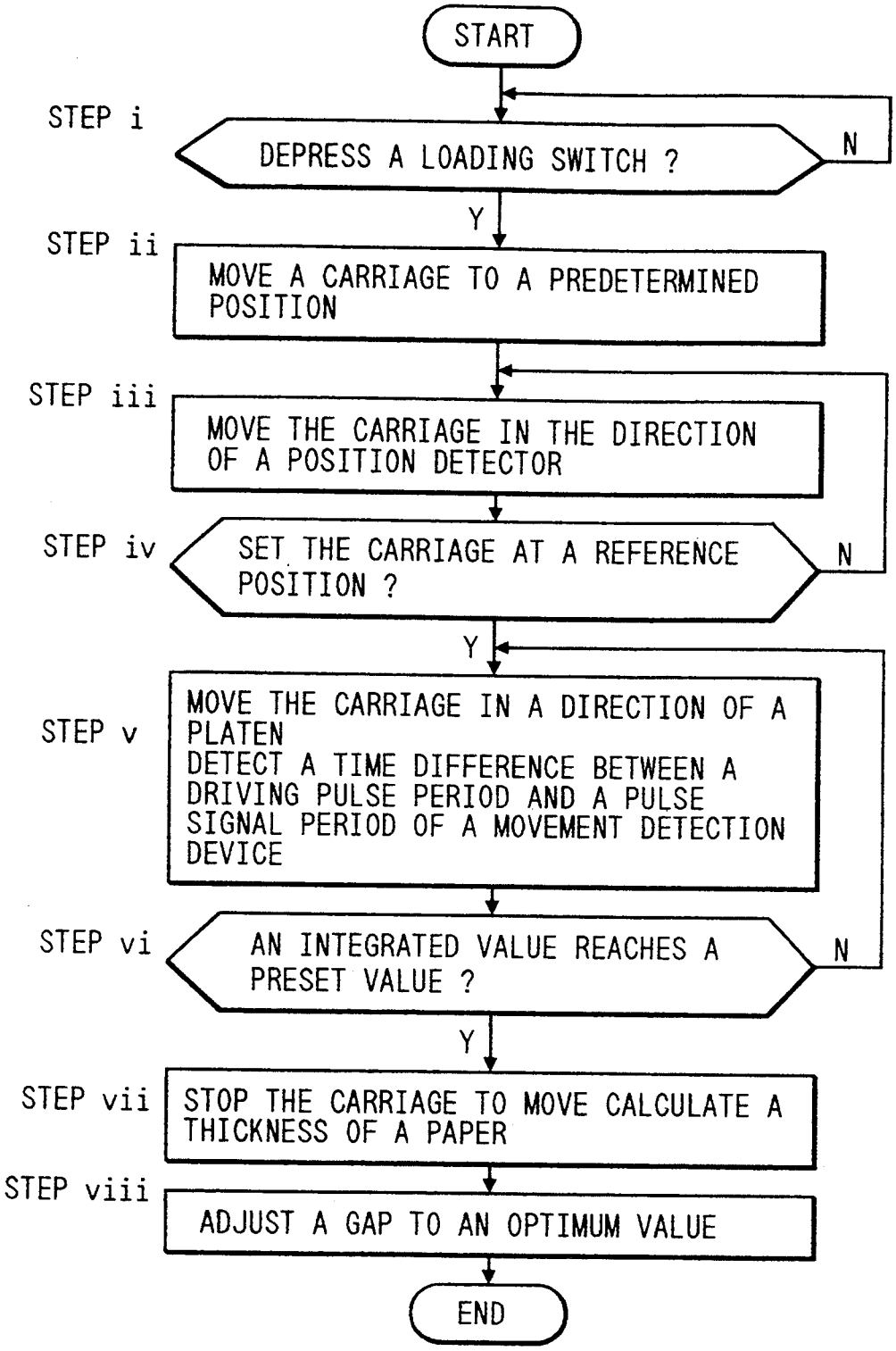
FIG. 3 is a flowchart showing the operation of a platen gap adjusting apparatus of the present invention.

Referring to the flowchart of FIG. 3, the operation of the apparatus thus constructed will now be described.

First, a loading switch (not shown) is depressed to load the recording paper (Step i). The control device 20 then moves the carriage 1 substantially to the center of the printing region (Step ii). This is done for the purpose of distributing potential parallel adjustment errors between the platen 4 and the guide shaft 3 uniformly to both the left and right sides of the printing region. Then the stepping motor 5 is inversely driven to move the carrier 1 in the direction of the position detector 11 (Step iii). The stepping motor 5 is stopped when the signal is produced from the position detector 11, that is, when the carriage 1 is set at the reference position (Step iv).

Then the control device 20 drives the stepping motor 5 in a positive direction at a predetermined speed, to move the carriage 1 in the direction of the platen 4. Simultaneously, the control device 20 counts the number of pulse signals from the rotary encoder 12. Incidentally, since the stepping motor 5 tends to operate irregularly when the carriage is initially moved, it is preferred to postpone detecting the time difference between the pulse signal of the rotary encoder 12 and the driving pulse of the stepping motor 5 until the stepping motor 5 has rotated approximately 30-pulse times.

Figure 4:
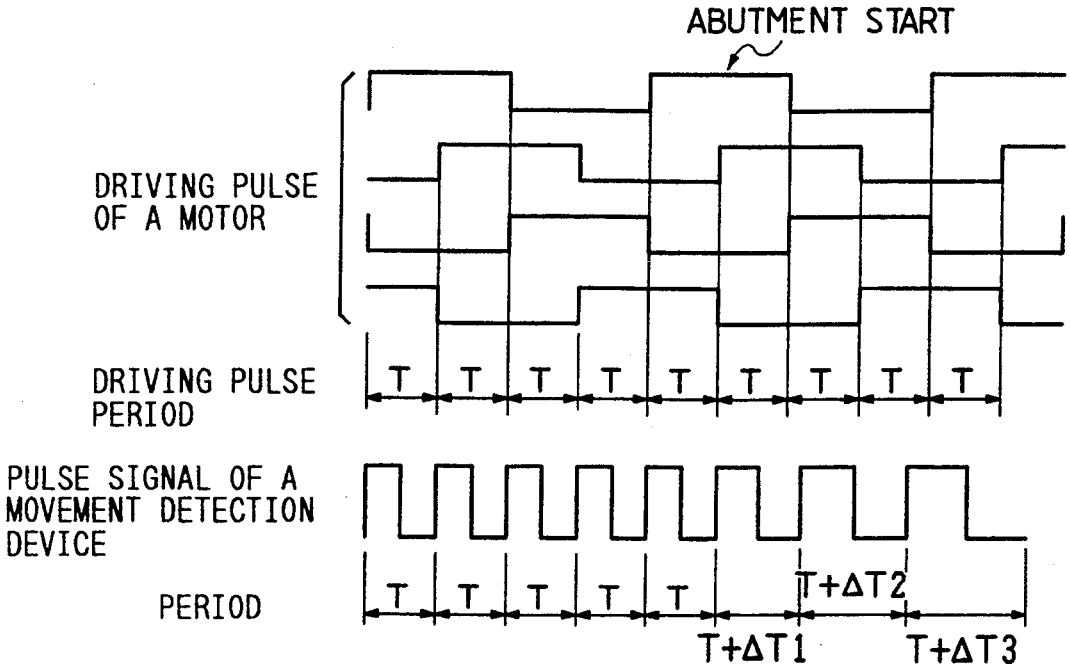
FIG. 4 is a waveform chart illustrating the operation of the apparatus of FIG. 3.

After the carriage is thus moved by the predetermined number of pulses, the time difference detection device 21 detects an occurrence of the time difference between the driving pulse period of the stepping motor 5 and the pulse signal period of the rotary encoder 12. As shown in FIG. 4, since a load acting on the stepping motor 5 is constant until the recording head 2 abuts against the recording paper, the integrated value of the time difference between each pulse signal period of the rotary encoder 12 and the driving pulse period of the stepping motor 5 is zero during this time (Step v).

When the recording head 2 abuts against the recording paper, additional load is thereby applied to the carriage 1, so that the speed of the rotary encoder 12 decreases, and the pulse signal period slows, whereby the time difference $\Delta Tn$ is produced. The time difference integrating device 22 sequentially integrates the time difference $\Delta Tn$, and then supplies the results to the abutment decision device 23. The load thus increases as the carriage 1 moves closer to the platen, thus causing the integrated value $\Sigma(\Delta Tn)$ of the time difference to sharply increase. When the integrated value $\Sigma(\Delta Tn)$ reaches the preset value (Step vi), the abutment decision device 23 determines that the recording head 2 has abutted against the recording paper, and outputs a signal.

On receiving the signal from the abutment decision device 23, the control device 20 stops the operation of the stepping motor 5, so that the carriage 1 stops moving. Further, the paper thickness calculation device 24 stops counting the number of pulses from the rotary encoder 12, and calculates the thickness of the paper (Step vii). The control device 20 drives the stepping motor 5 to make the carriage 1 move in the direction of the arrow A in FIG. 2 up to the optimum position, so that the gap is adjusted to an optimum value on the basis of the calculated thickness of the paper (Step viii). According to the embodiment of the present invention, although the carriage 1 has actually abutted against the recording paper, the abutment of the carriage 1 is determined before the stepping motor 5 steps out. Since no useless driving pulses are supplied to the stepping motor 5, there is no danger of putting press marks on the recording paper.

Figure 5:
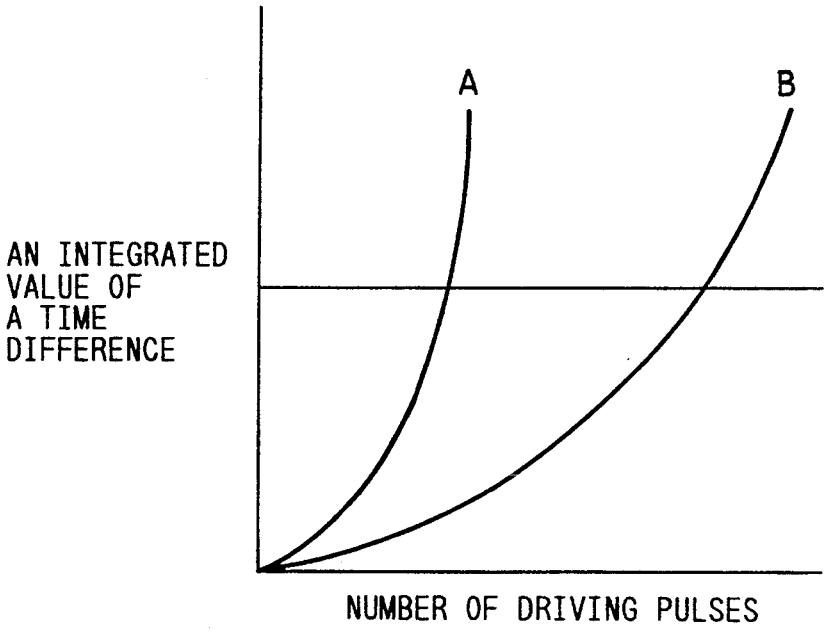
FIG. 5 is a diagram illustrating the relation between kinds of paper and the number of driving pulses.

FIG. 5 shows the form of an increase in the integrated value $\Sigma(\Delta Tn)$ of the time difference after the recording head 2 has started abutting against the recording paper. As shown in FIG. 5 (particularly, curve A), in the case of hard paper such as kraft paper, the value rapidly increases because the paper is substantially free from deformation even though it is pressed by the recording head 2. Further, as shown in FIG. 5 (particularly, curve B), in the case of a plurality of stacked sheets of copying paper, the value increases relatively gently because the copying paper is slightly deformed by the pressure from the recording head 2. If these changes in the form of the number of pulses is employed as decision-making information, it is possible to set the gap by taking into consideration not only the thickness but also the quality of the recording paper, so that printing of higher quality becomes feasible.

Although the reference position detection device 11 is used to determine the reference position in the aforesaid embodiment of the present invention, a similar result can be achieved by applying the above abutment decision method to measuring the distance between the carriage position and the surface of the platen, then moving the carriage back to the original position, and then obtaining the distance to the position where the carriage abuts against the platen loaded with recording paper.

Figure 6:
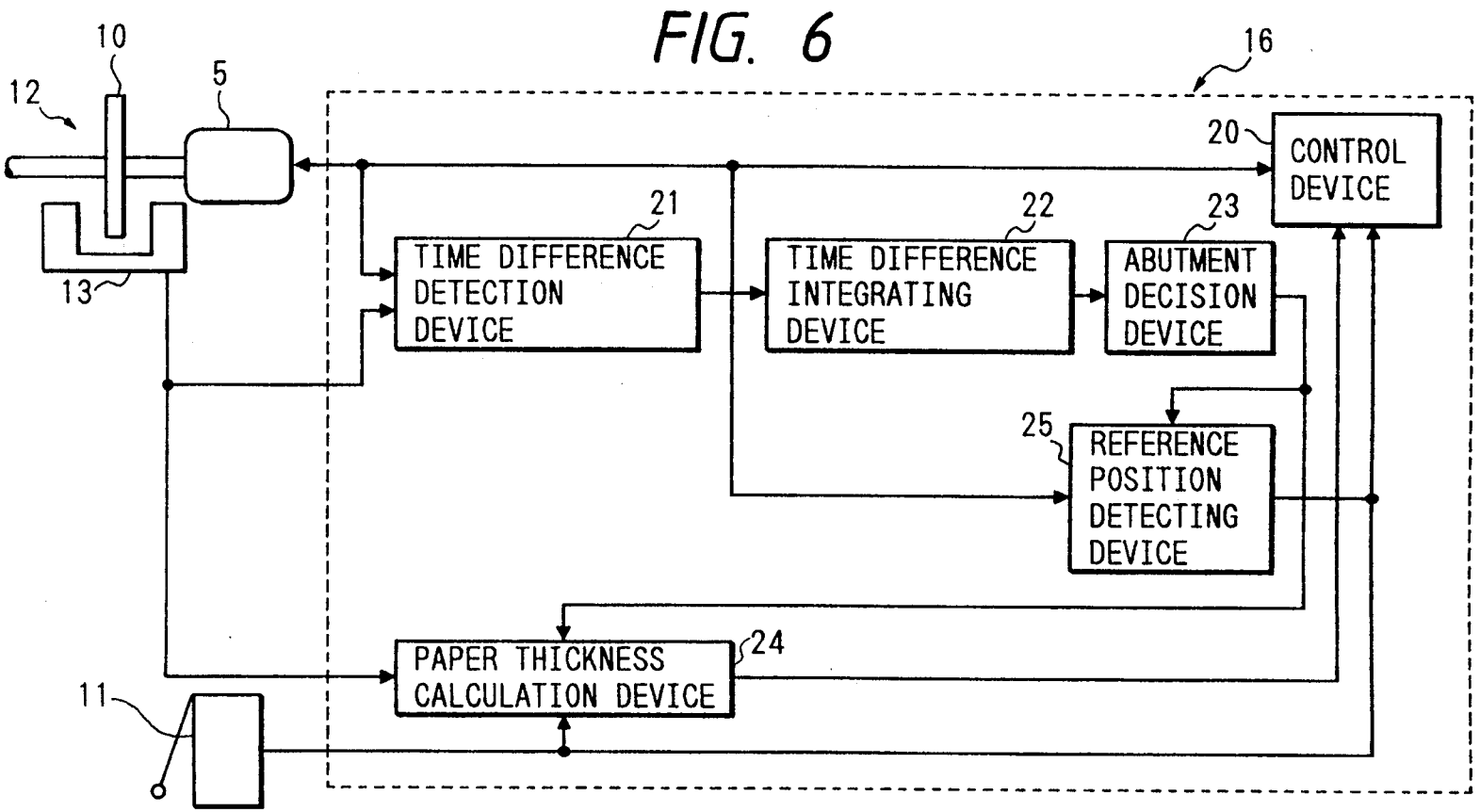
FIG. 6 is a block diagram illustrating another embodiment of the present invention.

More specifically, a reference position detecting device 25 is provided as shown in FIG. 6. The carriage is moved in the direction of the platen to register the time when a signal is produced from the abutment decision device 23. Then the carriage is moved back by a predetermined distance from the surface of the platen, whereupon the reference position detecting device 25 stores the distance moved as a certain number of driving pulses. The recording paper is subsequently loaded. As in the case of the preceding embodiment, operational steps are followed in accordance with the data from the reference position detecting device 25, whereby the thickness of the recording paper can be determined.

Figure 7:
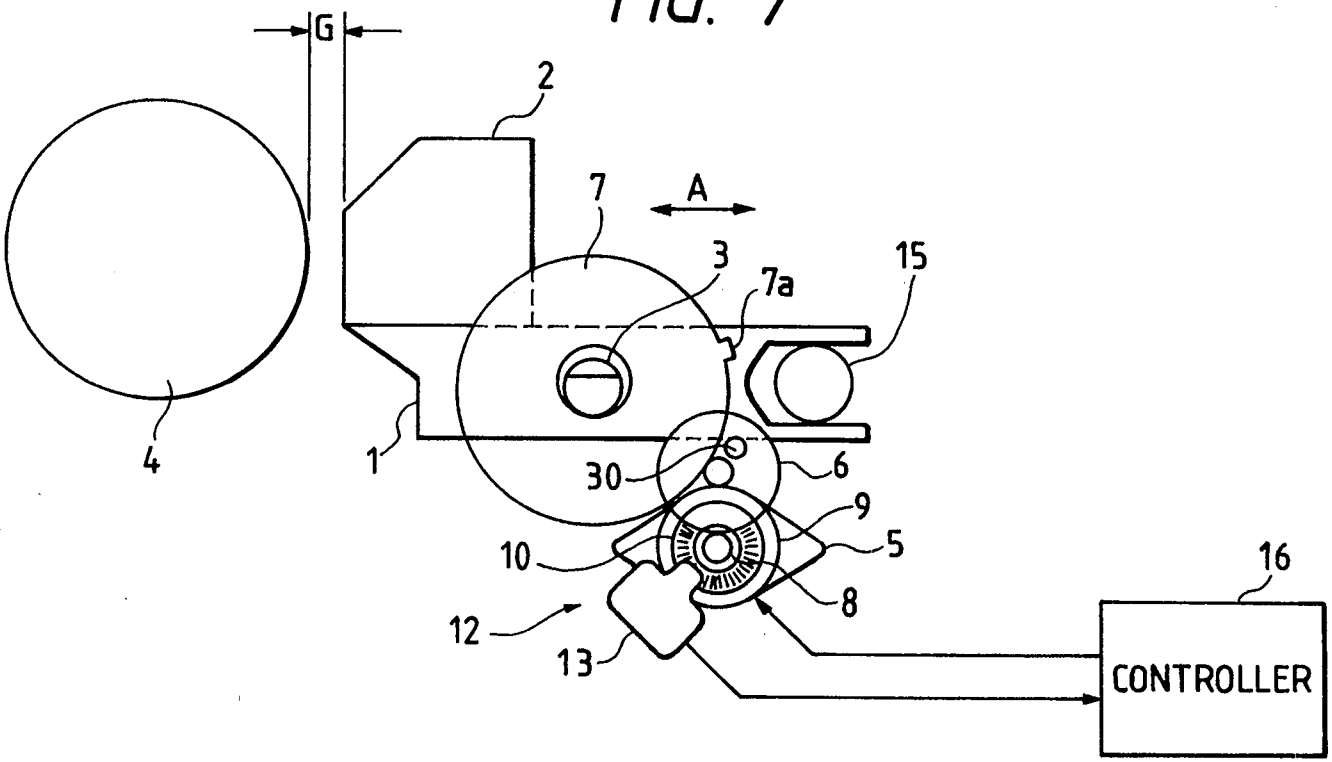
FIG. 7 is a block diagram illustrating still another embodiment of the present invention.

Further, a similar effect can be achieved by providing alternate devices for the carriage 1, for example, a bumper *7a* for the driven wheel 7 and a bumper settling pin 30 on the static side as shown in FIG. 7, and making use of these devices for mechanically setting the reference position.

Although the rotary encoder 12 fitted to the stepping motor 5 is used to detect the movement of the carriage 1 in the direction of the platen according to the present embodiment, similar results are obtained by providing, between the carriage 1 and the base, a displacement measurement device such as a magnet scale for converting the linear distance into the number of pulses.

Moreover, although in the described arrangement, the driving signal of the stepping motor 5 for driving the carriage is synchronized with the pulse signal of the rotary encoder 12, a similar effect is achieved by using the number of driving pulses contained in the pulse signal period to determine the moving state of the carriage when the signal period is greatly shorter than the period of the pulse signal of the rotary encoder 12.

Still further, the special stepping motor is used to move the carriage in the vertical direction of the platen shaft according to the embodiment above. However, such a special motor can be dispensed with provided the carriage is interlocked via a transmission mechanism with a stepping motor for reciprocating the carriage during the printing operation.

As set forth above, the automatic platen gap adjusting apparatus according to the present invention is provided with a stepping motor for moving the carriage loaded with the recording head in the vertical direction of the platen shaft, a movement detection device for outputting pulse signals proportional in number to the movement of the carriage, an abutment decision device for integrating the time difference between each stepping-motor driving pulse and the pulse signal originating from the driving operation based on the driving pulse and produced from the movement detection device by moving the carriage from the reference position in the direction of the platen so as to detect whether the integrated time difference value has reached a predetermined value, a paper thickness calculation device for calculating the corresponding thickness of recording paper on the basis of the movement of the carriage from the reference position, and a control device for adjusting the relative gap between the carriage and the platen by driving the stepping motor according to the data given by the paper thickness calculation device. Consequently, the point of abutment can be ascertained without pressing the recording paper against the platen with needlessly great force. Consequently, press marks are prevented from being left on the recording paper. Moreover, the time of abutment can be determined precisely, as unstable behavior at that time can be dealt with statistically. Not only the thickness but also the quality of recording paper is taken into consideration. Further, the relative gap between the platen and the recording head can be set on the basis of an increasing rate of an integrated value over time, so that the corresponding kind of recording paper can be determined from this calculation.

What is claimed is:

1. An automatic platen gap adjusting apparatus comprising:

a stepping motor for moving a carriage provided with a recording head in a direction of a platen;

a movement detection means for outputting pulse signals proportional in number to an extent of movement of the carriage;

an abutment decision means for integrating a time difference between each driving pulse from said stepping motor and the pulse signals produced by said movement detection means in response to moving the carriage from a reference position in the direction of the platen, and for detecting whether an integrated time difference value has reached a predetermined value;

a paper thickness calculation means for calculating a thickness of recording paper, on the basis of the movement of the carriage from the reference position, when a signal is produced from said abutment decision means; and a control means for adjusting a relative gap between the carriage and the platen by driving said stepping motor in accordance with data output by said paper thickness calculation means.

2. The automatic platen gap adjusting apparatus of claim 1, further comprising a moving means for moving the carriage to a substantially central position of a printing region, so that the relative gap between the carriage and the platen is adjusted at the central position.

3. The automatic platen gap adjusting apparatus of claim 1, wherein integrating the time difference is carried out after the movement of the carriage is stabilized.

4. The automatic platen gap adjusting apparatus of claim 1, wherein said movement detection means outputs one pulse signal in synchronization with one driving pulse.

5. The automatic platen gap adjusting apparatus of claim 4, wherein the predetermined value of the integrated time difference value for deciding an abutment state is not greater than one half of a driving pulse period of said stepping motor.

6. The automatic platen gap adjusting apparatus of claim 1, further comprising an identifying means for identifying the recording paper from variations in the integrated time difference value with the passage of time.

7. A method for automatically adjusting a gap between a platen and a print head, comprising the steps of:

driving a motor to move the print head from a reference position toward the platen, thereby generating periodic motor-driving pulses;

generating signals measuring a distance travelled by the print head toward the platen, whereby the signals are timed to calibrate with the pulses only during unobstructed travel of the print head toward the platen;

detecting and aggregating time differences detected by comparing the pulses with the signals;

when the aggregated time differences reach a predetermined threshold, generating an output; and in response to the generated output, executing a routine for making a final adjustment to the gap.

8. The method according to claim 7, wherein said step of executing the routine for making the final adjustment comprises:

calculating a thickness of recording paper loaded between the print head and the platen in response to the generated output; and adjusting the gap between the platen and the print head in accordance with the calculated thickness.

9. The method according to claim 7, whereby the signals generated in said generating step are generated by rotary encoder formed of a circular code plate and a code detection device.

10. The method according to claim 7, wherein the time differences are summed in said detecting and aggregating step.

11. The method according to claim 7, wherein the signals measuring the distance travelled by the print head toward the platen are generated from an intermediate point between the reference position and the platen.

12. The method according to claim 7, wherein the signals are calibrated such that one of the signals is generated for each of the pulses during the unobstructed travel of the print head toward the platen.

* * * * *